US008385801B2

(12) United States Patent
Sugaya

(10) Patent No.: US 8,385,801 B2
(45) Date of Patent: Feb. 26, 2013

(54) IMAGE HEATING APPARATUS

(75) Inventor: Kenjirou Sugaya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 345 days.

(21) Appl. No.: 12/637,991

(22) Filed: Dec. 15, 2009

(65) Prior Publication Data

US 2010/0150621 A1 Jun. 17, 2010

(30) Foreign Application Priority Data

Dec. 17, 2008 (JP) ..... 2008-320764

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 5,742,878 | A * | 4/1998 | Kuroda | 399/122 |
| 5,828,035 | A * | 10/1998 | Kuroda | 219/216 |
| 7,130,572 | B2 * | 10/2006 | Kubochi et al. | 399/329 |
| 7,212,775 | B2 | 5/2007 | Kachi | 399/329 |
| 8,041,228 | B2 * | 10/2011 | Charlet et al. | 398/158 |
| 8,055,175 | B2 * | 11/2011 | Sugaya | 399/329 |
| 2007/0231026 | A1 * | 10/2007 | Hayashi et al. | 399/329 |

FOREIGN PATENT DOCUMENTS

| | | |
|---|---|---|
| JP | 10-074007 | 3/1998 |
| JP | 10-231597 | 8/1998 |
| JP | 2002-82549 | 3/2002 |
| JP | 2005-062554 | 3/2005 |
| JP | 2006-047988 | 2/2006 |

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image heating apparatus includes a magnetic flux generator for generating magnetic flux; and a rotatable belt including an electroconductive layer which generates heat by the magnetic flux generated by the generator and having flexibility and a cylindrical shape. The generator is outside the belt. The apparatus further includes a back-up member inside the belt member; a rotatable pressor for pressing the belt against the back-up member to form a nip, in which a recording material is nip-conveyed; and a regulator, provided in a sheet passing area of a passable recording material having a maximum size, for regulating movement of the recording material with respect to a longitudinal direction of the belt. The regulator regulates the shape of the belt so that the belt dimension member in a recording material conveying direction is longer than the belt dimension perpendicular to the recording material conveying direction.

8 Claims, 10 Drawing Sheets

(a)

(b)

IMAGE HEATING APPARATUS

FIELD OF THE INVENTION AND RELATED ART

The present invention relates to an image heating apparatus of an electromagnetic (magnetic) induction heating type suitably used as an image fixing apparatus (device) to be mounted in an image forming apparatus, such as a copying machine, a printer, or a facsimile machine, or a multi-function machine thereof, for effecting image formation through an electrophotographic system, an electrostatic recording system, a magnetic recording system, or the like.

From the viewpoints of energy saving and reducing the waiting time for the use of the image forming apparatus, as a fixing device, a device which is capable of heating a heating member (fixing member) to a predetermined temperature instantaneously and is reduced in waiting time (WUT: warm-up time) has been desired. As a heating means, in place of a halogen lamp, a fixing device utilizing an induction heating method has been developed.

Japanese Laid-Open Patent Application (JP-A) 2002-082549 discloses a fixing device utilizing the induction heating method and having the following constitution. The fixing device includes a fixing belt, a rotatable heat generating roller internally contacting the fixing belt and having electroconductivity at at least a portion thereof, a fixing roller movably stretching the fixing belt between it and the heat generating roller, and an exciting means disposed outside the heat generating roller that excites the heat generating roller to be heated. The exciting means excites the heat generating roller to be heated after a rotational operation of the heat generating roller is started.

In order to reduce the WUT, as a constitution using a heat generating belt, not a heat generating roller, for lowering thermal capacity, there is a technique as described in JP-A Hei 10-074007. This technique employs a fixing device such that a thin heat generating belt having an electroconductive layer is induction-heated by a magnetic field generated by a magnetic field generating means and an unfixed toner image on a recording material (medium) is fixed in a nip between the heat generating belt and a pressing member opposing the heat generating belt. Further, inside the heat generating belt, a pressing (urging) member having an elastic layer is provided and is caused to press the heat generating belt against the pressing member to form a nip for fixation. The fixing device further includes a regulating member at belt end portions.

Further, JP-A Hei 11-231597 discloses a constitution for improving the heat generating efficiency of induction heating. In this constitution, the distance between a magnetic flux generating coil and an induction heat generating member is kept at a constant level by a non-magnetic gap holding member and an embodiment in which the magnetic flux generating coil is placed outside a main body of the fixing roller is included.

With respect to the fixing device for reducing the WUT, the above-described conventional constitution using a combination of the thin belt and the induction heating can be considered. By the use of the thin belt, the thermal capacity can be suppressed and it is also possible to reduce the WUT. In consideration of durability, a constitution in which a free belt to which no tension is applied is used can be considered. In this constitution, the magnetic flux generating coil in the magnetic field generating means is a member formed in an elongated shape in a longitudinal direction thereof perpendicular to a rotational direction of the belt and is disposed outside the belt while keeping a gap of 0.5 mm to 2 mm with respect to the belt. The belt is brought near to the magnetic flux generating coil as the exciting means to be disposed in a high magnetic flux density area, so that efficient heating can be effected. Therefore, the power source frequency can be lowered, so that it becomes possible to downsize the power source and to reduce the cost of the power source. However, in the free belt constitution, the belt causes flapping with respect to its circumferential direction, so that the distance between the belt and the magnetic field generating means is unstable, thus resulting in a problem of an occurrence of heat generation non-uniformity. As a constitution for regulating the belt, such a constitution that the belt is regulated in its entire longitudinal direction can be considered. However, in the case where the belt is regulated in its entire longitudinal direction in the belt fixing device using such a free belt, there arises a problem of belt slip due to the occurrence of sliding resistance leading to a large load with respect to drive.

SUMMARY OF THE INVENTION

A principal object of the present invention is to provide an image heating apparatus capable of reducing the degree of fluctuation in the distance between a belt member and a magnetic flux generating means caused by rotation of the belt member.

According to an aspect of the present invention, there is provided an image heating apparatus comprising:

a magnetic flux generating unit for generating magnetic flux;

a rotatable belt member including an electroconductive layer which generates heat by the magnetic flux generated by the magnetic flux generating unit and having flexibility and a cylindrical shape;

wherein the magnetic flux generating unit is provided outside the belt member, a back-up member disposed inside the belt member;

a rotatable pressing member for pressing the belt member against the back-up member to form a nip, in which a recording material is nip-conveyed, between the pressing member and the belt member; and a regulating member, provided in a sheet passing area of a passable recording material having a maximum size, for regulating movement of the recording material with respect to a longitudinal direction of the belt member, wherein the regulating member regulates the shape of the belt member so that when the pressing member forms the nip, the dimension of the belt member with respect to a conveying direction of the recording material is longer than the dimension of the belt member with respect to a direction perpendicular to the conveying direction of the recording material and perpendicular to the longitudinal direction of the belt member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the present invention will be described specifically based on embodiments with reference to the drawings but is not limited to the following embodiments.

Embodiment 1

(1) Image Forming Apparatus

Figure 1:
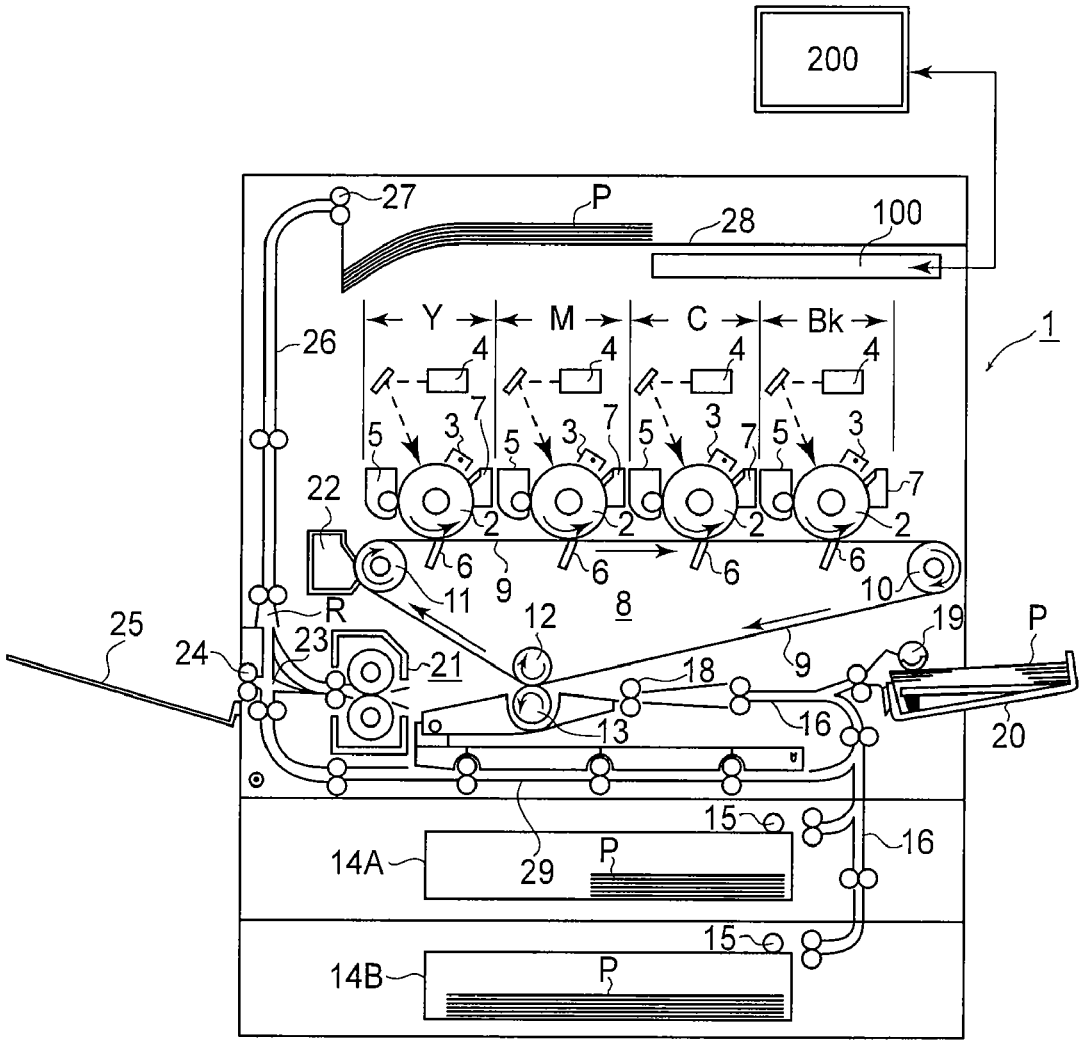
FIG. 1 is a longitudinal sectional view showing a schematic structure of an image forming apparatus in Embodiment 1.

FIG. 1 is a longitudinal schematic view showing the general structure of an electrophotographic full-color printer 1 as an example of an image forming apparatus in which the image heating apparatus according to the present invention is mounted as a fixing device.

This printer 1 performs an image forming operation depending on image information inputted from an external host device 200 communicatably connected with a control circuit portion (control board: CPU) 100, thus being capable of forming a full-color image on a sheet P and then outputting the full-color image.

The external host device 200 is a computer, an image reader, a facsimile machine or the like. The control circuit portion 100 as the control portion sends signals to and receives signals from the external host device 200. Further, the control circuit portion 100 sends signals to and receives signals from various devices for image formation on the printer side to manage image forming sequence control. As the recording material, it is possible to use plain paper, a resin material sheet-like product, thick paper, an OHP (overhead projector) sheet, envelope, post card, label, and the like.

In the printer, first to fourth image forming stations Y, M, C and Bk are disposed side by side from left to right in FIG. 1 with respect to a horizontal direction (in-line or tandem constitution). Each of the image forming stations is an electrophotographic process mechanism of a laser exposure type and has the same constitution except that the color of a developer (toner) accommodated in a developing device. That is, each of the image forming stations Y, M, C and Bk includes a drum-type electrophotographic photosensitive member (image bearing member, hereinafter referred to as a drum) 2 rotationally driven in a counterclockwise direction indicated by an arrow at a predetermined speed. Around each drum 2, a primary charger 3, a laser scanner 4, a developing device 5, a primary transfer blade 6, and a cleaner 7 which are process means acting on the drum 2 are disposed.

Under the image forming stations Y, M, C and Bk, an intermediary belt unit 8 is disposed. The belt unit 8 includes an intermediary transfer belt 9 which is flexible and endless (hereinafter referred to as a belt) and rollers, around which the belt 9 is extended, including a driving roller 10, a tension roller 11 and a secondary transfer opposite roller 12. The primary transfer blade 6 of each of the image forming stations Y, M, C and Bk is disposed inside the belt 9 and presses an upper belt portion, between the tension roller 11 and the driving roller 10, against the lower surface of the drum 2. A contact portion between each drum 2 and the belt 9 constitutes a primary transfer portion. Against the secondary transfer opposite roller 12, a secondary transfer roller 13 presses the belt 9. A contact portion between the belt 9 and the secondary transfer roller 13 constitutes a secondary transfer portion. The belt 9 is circulatingly moved in a clockwise direction indicated by an arrow at a speed corresponding to the rotational speed of the drum 2 by the driving roller 10.

In this embodiment, the first image forming station Y accommodates the developer of yellow (Y) and forms a Y toner image on the drum 2. The second image forming station M accommodates the developer of magenta (M) and forms a M toner image on the drum 2. The third image forming station C accommodates the developer of cyan (C) and forms a C toner image on the drum 2. The fourth image forming station Bk accommodates the developer of black (Bk) and forms a Bk toner image on the drum 2.

The control circuit portion 100 causes each of the image forming stations Y, M, C and Bk to perform an image forming operation on the basis of a color-separated image signal inputted from the external host device 200. As a result, at the respective image forming stations Y, M, C and Bk, color toner images of yellow (Y), magenta (M), cyan (C), and black (Bk) are formed, respectively, on surfaces of associated rotating drums 2. The electrophotographic image forming principle and process for forming a toner image on the drum 2 are well known in the art, and are thus being omitted from this description.

The toner images formed on the drums 2 at the respective image forming stations Y, M, C and Bk are successively transferred onto an outer surface of the belt 9, in a superposition manner, which is rotationally driven in the same direction as the rotational directions of the respective drums 2 at a speed corresponding to the rotational speeds of the respective drums 2. As a result, on the surface of the belt 9, unfixed full-color toner images are synthetically formed in a superposition manner of the above-described four toner images Y, M, C and Bk.

With predetermined sheet feeding timing, a sheet-feeding roller 15 at a stage selected from a plurality of sheet-feeding cassettes 14A and 14B in which various sheets P having different widths (hereinafter referred to as a sheet) are stacked and accommodated is driven. As a result, one sheet P stacked and accommodated in the sheet-feeding cassette at the selected stage is separated and fed to be conveyed to registration roller pair 18 through a conveying path 16. When a manual sheet feeding mode is selected, a sheet-feeding roller 19 is driven. As a result, one sheet P placed and set on a multi-sheet feeding tray 20 is separated and fed to be conveyed to the registration roller pair 18 through the conveying path 16.

The registration roller pair 18 once receives the sheet P and, in the case where the sheet P is obliquely moved, causes the sheet P to move in a straight line. Then, the registration roller pair 18 sends the sheet P to a secondary transfer portion which is the contact portion between the belt 9 and the secondary transfer roller 13 in synchronism with the toner images on the belt 9. As a result, at the secondary transfer portion, the full-color synthetic toner images on the belt 9 are secondary-transferred collectively onto the surface of the sheet P. The sheet P coming out of the secondary transfer portion is separated from the surface of the belt 9 and guided into the fixing device 21. By this fixing device 21, the above-described toner images of a plurality of colors on the sheet P are melted and mixed to be fixed on the surface of the sheet P as a fixed image.

The surface of the belt 9 after the separation of the sheet P at the secondary transfer portion is subjected to removal of residual deposited matter such as secondary transfer residual toner or the like by a belt cleaner 22 to be cleaned, thus being repeatedly subjected to image formation.

In the case of a monochromatic (one-side) print mode, only the fourth image forming station Bk for forming the black toner image is actuated. In the case of the one-side print mode, the path of the sheet P coming out of the fixing device 21 is switched by a switching flapper 23 in accordance with a predetermined designation to be discharged on a face-up sheet discharge tray 25 disposed on the side surface of the printer or discharged on a face-down sheet discharge tray 28 disposed on the upper surface of the printer. In the case of the discharge on the tray 25, the sheet P coming out of the fixing device 21 passes through the lower surface side of the flapper 23 placed in a first attitude in a straight line and is discharged on the tray 25 by first sheet discharge rollers 24 with an image surface up. In the case of the discharge on the tray 28, the sheet P coming out of the fixing device 21 passes through the upper surface side of the flapper 23 placed in a second attitude and is guided upward, thus being conveyed upward through a conveying path 26. Then, the sheet P is discharged on the tray 28 by second sheet discharge rollers 27 with an image surface up.

In the case of the both-side print mode, the sheet P on which the first surface has already been subjected to image formation and fixation and which comes out of the fixing device 21 passes through the upper surface side of the flapper 23 placed in the second attitude and is guided upward, thus being conveyed upward through the conveying path 26. When a trailing end of the sheet P reaches a reversing point R during the conveyance of the sheet P, the drive mode along the conveying path 26 is changed into a reverse conveying drive mode. As a result, the sheet P is moved back to enter a both-side conveying path in a reversed state. As a result, the sheet P is subjected to image transfer on a second surface. The sheet P coming out of the secondary transfer portion is guided into the fixing device 21 again. The path of the sheet P which has been subjected to the both-side printing and comes out of the fixing device 21 is, similarly as in the case of the one-side print mode, switched by the switching flapper 23 in accordance with the predetermined designation to be discharged on the tray 25 or the tray 26. A portion constituted by the flapper 23, the conveying path 28, and the like is an example of a reversing means.

(2) Fixing Device 21

The fixing device 21 in this embodiment uses a flexible rotatable member, (a thin fixing belt having an electroconductive layer (induction heat generating member)) which generates heat by the action of magnetic flux, as the heating member (fixing member) for heating the sheet P. The fixing device 21 is an image heating apparatus of a belt heating type and a pressing rotatable member drive type (free belt type) in which the belt is heated through the induction heating by a magnetic field generating means (magnetic flux generating means) provided outside the belt.

In the following description, with respect to the fixing device 21 or members constituting the fixing device, a front surface is a surface at which the fixing device is viewed from a sheet (recording material) entrance side and a rear surface is a surface (sheet exit side) opposite from the front surface. Left and right directions are those in the case where the fixing device is viewed from the sheet entrance side. Further, the longitudinal direction is a direction parallel to a direction perpendicular to the sheet conveying direction in a plane of the sheet conveying path. A short direction is a direction perpendicular to the longitudinal direction. An upstream side and a downstream side are those with respect to the sheet conveying direction. A sheet passing width is a dimension of the sheet with respect to a direction perpendicular to the sheet conveying direction in a plane of the sheet.

Figure 2:
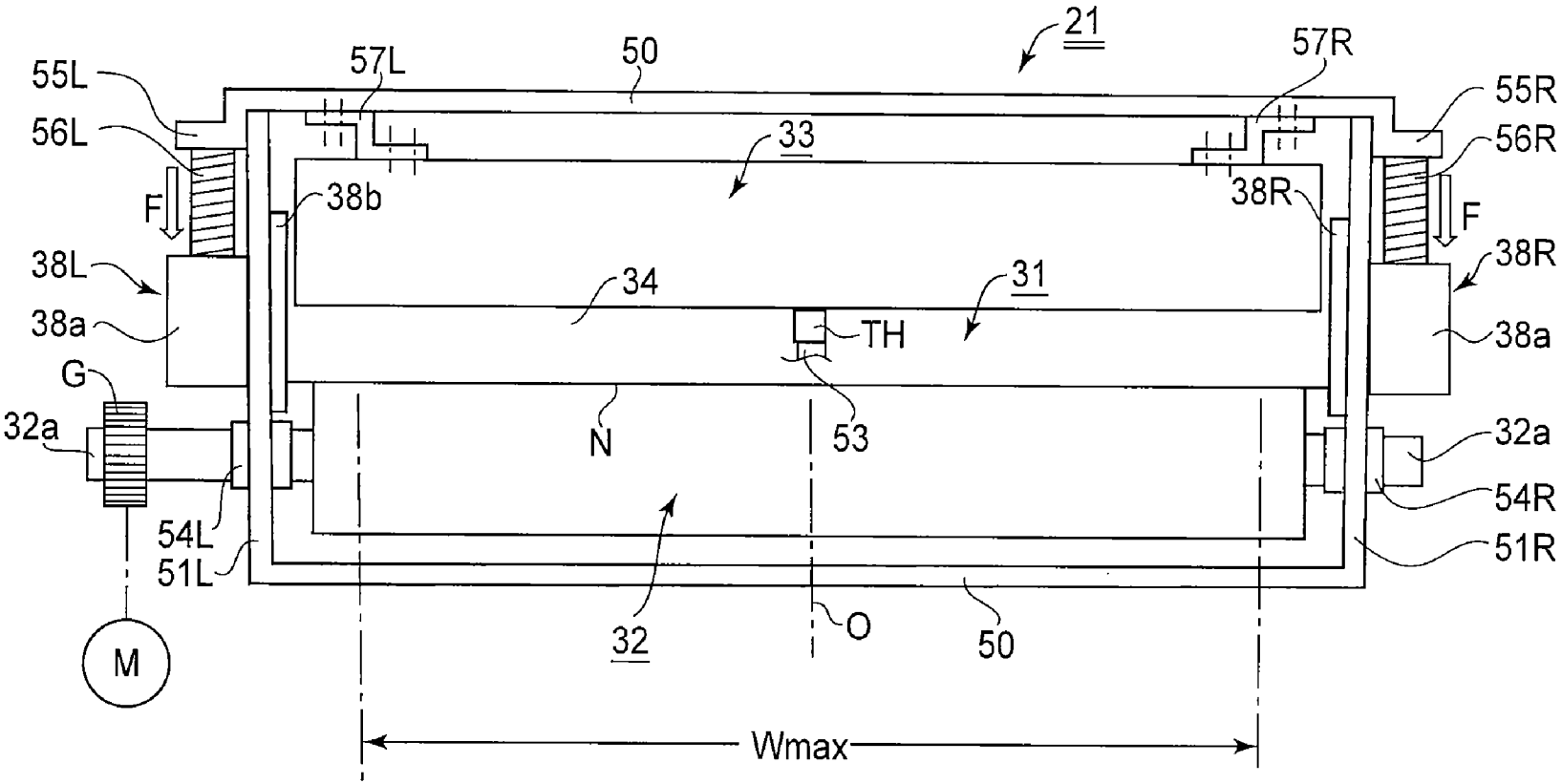
FIG. 2 is a schematic front view of the fixing device.
Figure 3:
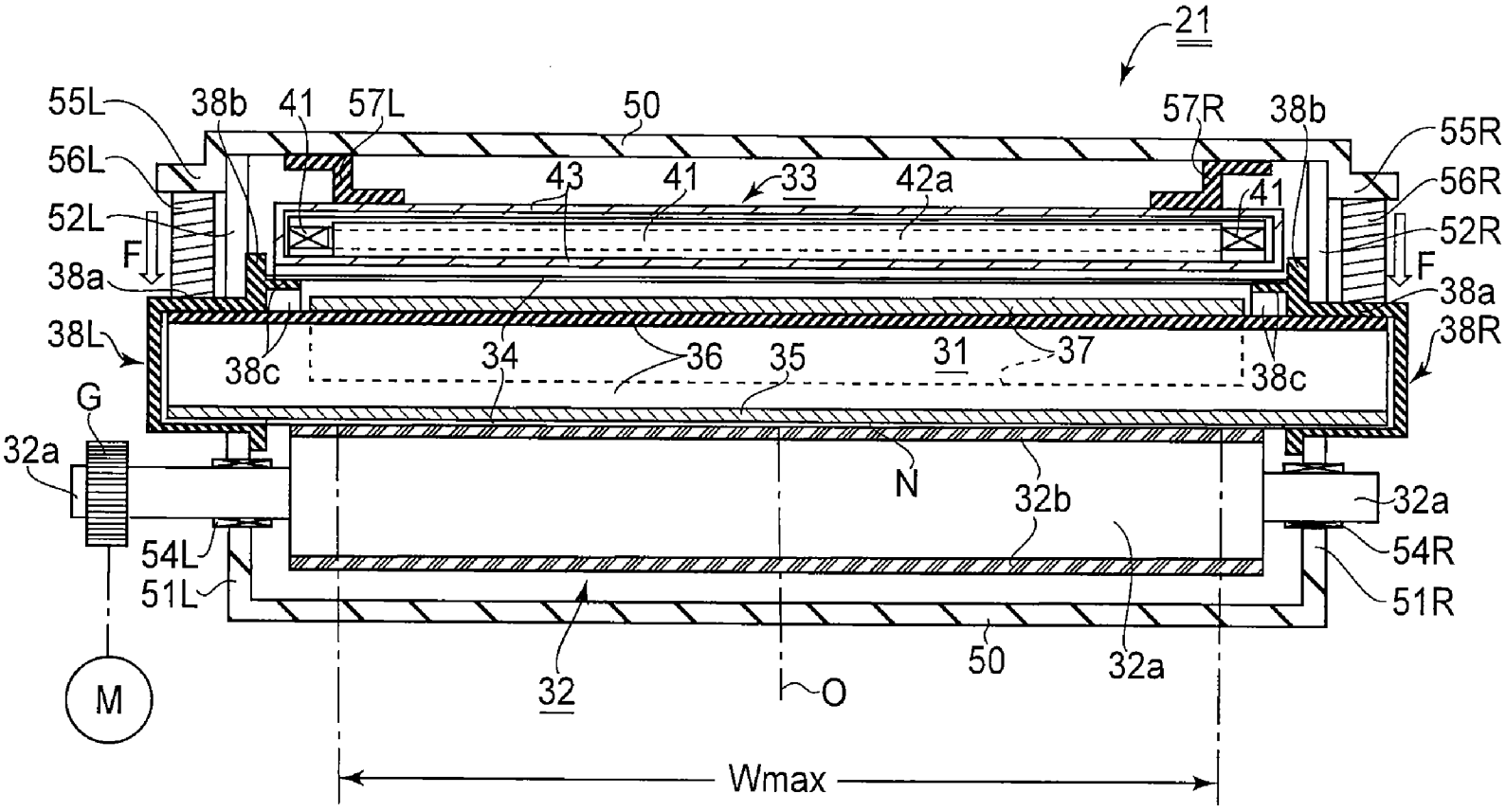
FIG. 3 is a schematic longitudinal sectional front view of the fixing device.
Figure 4:
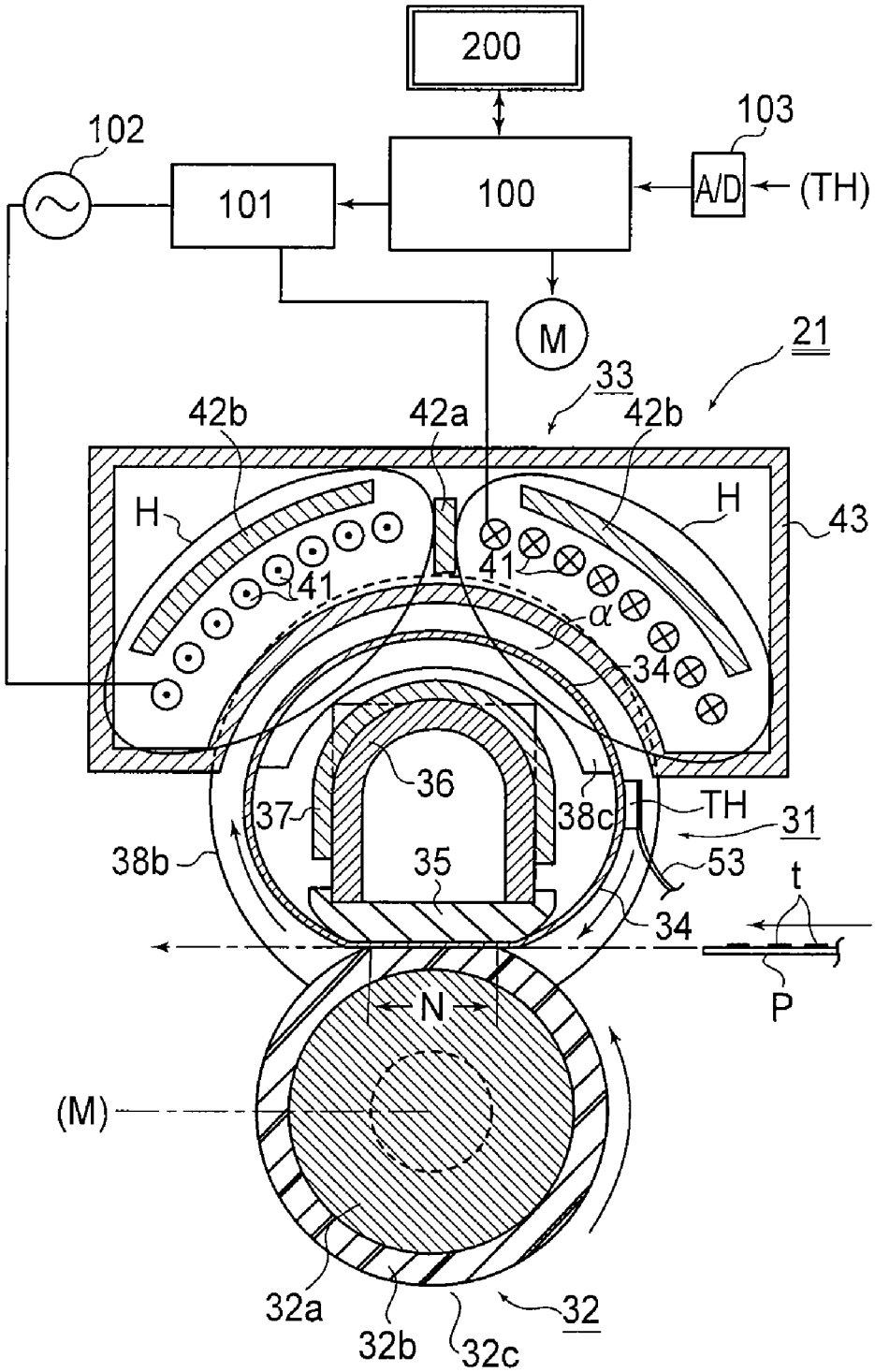
FIG. 4 is an enlarged schematic cross-sectional view of a principal part of the fixing device and a block diagram of a control system.

FIG. 2 is a schematic front view of the fixing device, and FIG. 3 is a schematic longitudinal sectional front view of the fixing device 21, and FIG. 4 is an enlarged schematic cross-sectional view of a principal part of the fixing device 21 and a block diagram of a control system.

The fixing device 21 includes a fixing belt unit 31 disposed and held between left and right opposite side plates 51L and 51R of a device frame (chassis) 50 at both longitudinal end portions of the belt unit 31. The fixing device 21 further includes a pressing roller 32, as the rotatable pressing member, disposed and held between the left and right opposite side plates 51L and 51R at both longitudinal end portions of the pressing roller 32. The belt unit 31 and the pressing roller 32 are disposed vertically in parallel to each other between the side plates 51L and 51R. The belt unit 31 and the pressing roller 32 press-contact each other to form a nip (fixing nip) N, between the pressing roller 32 and a fixing belt 34 on the belt unit 31 side, having a predetermined width with respect to the sheet conveying direction (short direction). Further, the fixing device 21 includes an exciting coil unit 33, as the magnetic field generating means for generating the magnetic flux, disposed parallel to the belt unit 31 and held by the device frame 51, on the side 180 degrees opposite from the pressing roller 32 side with respect to the belt unit 31. The exciting coil unit 33 is oppositely disposed outside and in non-contact with the belt 34 of the belt unit 31 with a substantially constant gap $\alpha$.

1) Belt unit 31

In the belt unit 31, the belt 34 uses ferromagnetic metal such as iron or the like (metal having high magnetic permeability), so that a larger amount of the magnetic flux generated from the coil unit 33 can be confined inside the metal. That is, the magnetic flux density can be increased, so that eddy currents are generated on the metal surface and therefore the belt is efficiently caused to generate heat. The belt unit 31 includes a fixing pad 35 as a back-up member and a pressing stay 36 as a pressing member which are inserted into and disposed inside the belt 34. The fixing pad 35 is a heat-resistant member composed of a heat-resistant resin material or the like. The pressing stay 36 is a molded steel product having rigidity such as SUS or the like and having an inverted U-like cross-sectional shape. The pressing stay 6 supports the fixing pad 35. Further, the belt unit 31 includes a magnetic core (magnetic shielding core) 37 formed inside the belt 34 of a ferromagnetic material in the inverted U-like cross section, as a magnetic shielding member, and disposed so as to cover an outer surface of the pressing stay 36. The length of the fixing pad 35 and the pressing stay 36 are longer than the length of the belt 34 and protrude from the both end portions of the belt 34 toward the outside at left and right (both) end portions of the fixing pad 35 and the pressing stay 36. With the protruded end portions, capping members 38L and 38R are engaged and fitted.

Figure 5:
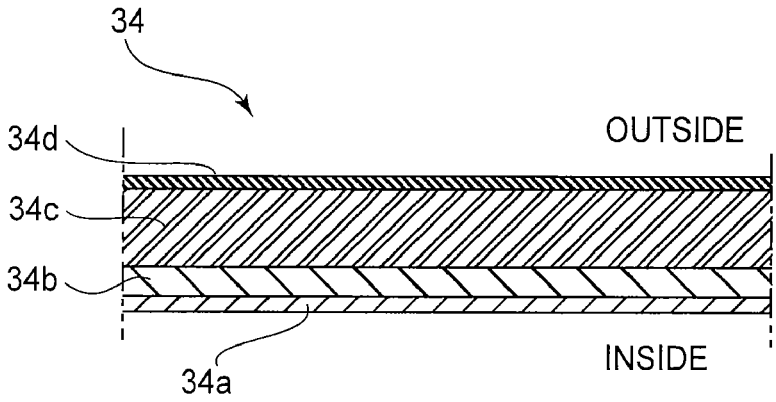
FIG. 5 is a schematic view showing a layer structure of a fixing belt.

FIG. 5 is a schematic view showing a layer structure of the belt 34 in this embodiment. The belt 34 is a composite layer belt including a cylindrical electroconductive layer (induction heat generating member: base layer) 34*b*, an inner layer 34*a* provided at an inner peripheral surface of the electroconductive layer 34*b*, and an elastic layer 34*c* and a surface parting layer 34*d* which are successively laminated on an outer peripheral surface of the electroconductive layer 34*b*, thus having flexibility as a whole and having a substantially cylindrical shape in a free state.

The inner surface layer 34*a* is provided to ensure slidability with a member contacting the inner surface of the belt and may preferably have a thickness of about 10 μm to about 100μ. In this embodiment, a 15 μm-thick polyimide (PI) layer is used as the inner surface layer 34*a*.

The electroconductive layer 34*b* is a layer which generates heat by the electromagnetic induction function of the magnetic flux generated by the coil unit 33 and is formed and used in an about 1-50 μm thick metal layer of iron, cobalt, nickel, copper, chromium, or the like. There is a need to reduce the WUT (waiting time) by lowering the thermal capacity, so that the electroconductive layer 34*b* may preferably be formed in a small thickness as thin as possible. In this embodiment, in order to compatibly realize the heat generating efficiency and the thermal capacity, as the electroconductive layer 34*b*, an about 40 μm-thick layer of nickel having high electrical conductivity is used.

The elastic layer 34*c* may preferably have a thickness as small as possible in order to improve the quick start property of the belt 34, but requires a certain degree of thickness in order to achieve such an effect that the belt surface is softened to encompass and melt the toner. Therefore, the elastic layer 34*c* may preferably have a thickness of approximately 10-1000 μm. In this embodiment, a 400 μm-thick rubber layer having a rubber hardness (JIS-A) of 10 degrees and a thermal conductivity of 0.8 W/m·K is used.

The surface parting layer 34*d* is a layer directly contactable to the unfixed toner image t formed on the sheet P, so that there is the need to use a material having good releasability. As a material constituting the surface parting layer 34*d*, e.g., it is possible to use a tetrafluoroethylene-perfluoroalkylvinyl ether copolymer (PFA), polytetrafluoroethylene (PTFE), a silicone copolymer, or a combination of these materials for forming a composite layer, or the like. The surface parting layer 34*d* is provided as an uppermost layer of the belt in a thickness of 1-50 μm of a material appropriately selected from the above materials. When the thickness of the surface parting layer 34*d* is excessively thin, durability is poor in terms of its anti-wearing property to shorten a life time of the fixing belt 34. On the other hand, when the thickness is excessively thick, the thermal capacity of the fixing belt 34 becomes large, thus undesirably increasing the WUT. In this embodiment, in view of a balance between the anti-wearing property and the thermal capacity of the belt 34, a 30 μm-thick layer of PFA is used.

The magnetic core 37 is disposed inside the belt 34 and opposes the coil unit 33 through the belt 34 and adjusts the magnitude of induced magnetic field exerted from the coil unit 33 to the belt 34. The magnetic core 37 has the function of improving a heat generating efficiency of the belt 34. Further, the magnetic core 37 also has the function of suppressing warming of the pressing stay 36 through induction heating by covering an outer surface of the pressing stay 36 as the metallic material to block the magnetic flux toward the pressing stay 36. As the magnetic core 37, a material having high magnetic permeability and low loss is used. The magnetic core 37 is used for enhancing an efficiency of a magnetic circuit and for magnetic shielding with respect to the pressing stay 36. As a typical example of the material for the magnetic core 37, ferrite core is used.

Figure 6:
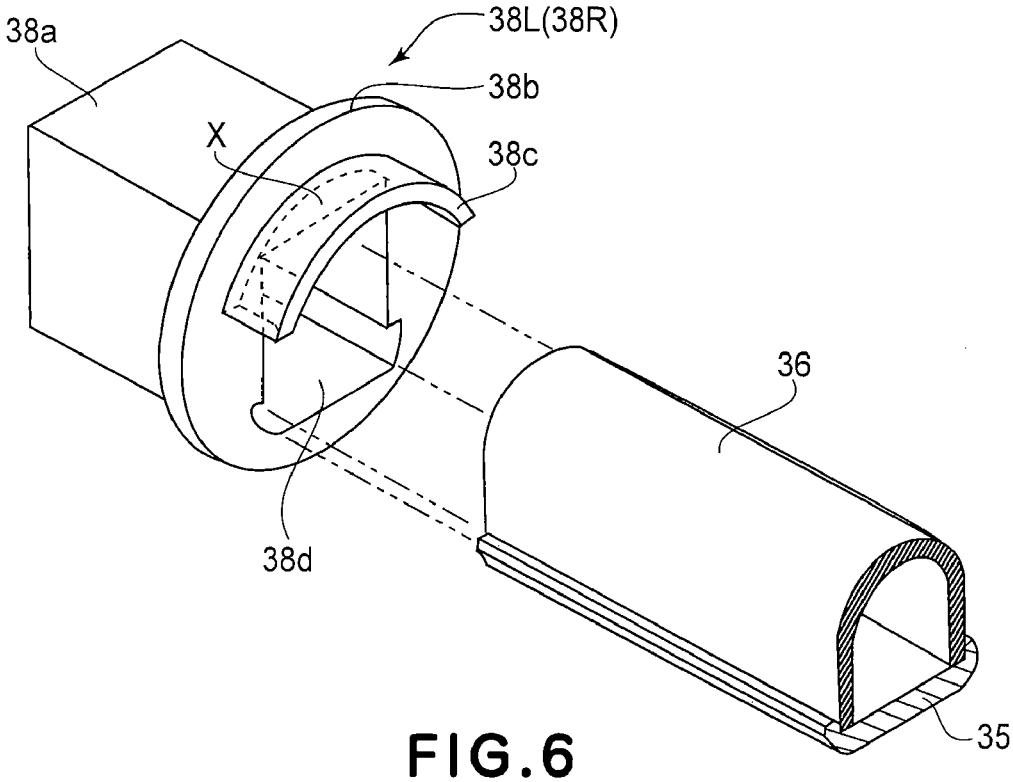
FIG. 6 is an exploded perspective view showing a capping member and a pressing stay which supports a fixing pad.

Left and right capping members 38L and 38R are heat-resistant members of a heat-resistant material and are a molded member having the same shape. FIG. 6 is an exploded perspective view showing the left (right) capping member 38L (38R) and the left (right) end portion of the pressing stay 36 which supports the fixing pad 35.

Each of the left and right capping members 38L and 38R includes a pressure-receiving portion 38*a* which covers an associated left (or right) end portion of the pressing stay 36 which supports the fixing pad 35. The capping members 38L and 38R further include a flange portions 38*b*, each provided integrally with the associated pressure-receiving portion 38*a*, opposing the left and right end surfaces of the belt 34. Further, each of the capping members 38L and 38R includes a guiding member 38*c*, provided integrally with the flange portion 38*b* on the inner surface side opposite from the pressure-receiving portion 38*a* side, for regulating a rotation locus of the belt 34 from the inside of the belt 34 by entering the inside of the belt 34. That is, the guiding member 38*c* has the function of supporting the belt 34 from the inside of the belt 34 at both end portions of the belt 34 and guiding the rotation locus of the belt 34. This will be described later. The pressure-receiving portion 38*a* and the flange portion 38*b* are provided with a hole 38*d* for permitting insertion of the end portion of the pressing stay 36 which supports the fixing pad 35. In a state in which the left and right capping members 39L and 39R are engaged and fitted with the left and right end portions of the pressing stay 36 which supports the fixing pad 35, the pressure-receiving portions 38*a* are engaged with vertical guide slit portions 52L and 52R, respectively, provided to the left and right opposite side plates 51L and 51R of the device frame 50. As a result, the left and right capping members 38L and 38R are guided by the vertical guide slit portions 52L and 52R, respectively, thus being disposed slidably (movably) in a direction toward the pressing roller 32 and its opposite direction with respect to the left and right opposite side plates 51L and 51R.

Outside the belt 34, a thermistor TH as a temperature detecting means for detecting the belt temperature in order to control the temperature of the belt 34 is disposed. This thermistor TH is caused to elastically contact the outer surface of the belt 34 at its temperature detecting portion by a spring property of an elastic member 53 while a base portion thereof is held at an end portion of the elastic member 53. The thermistor TH may also be configured to be disposed inside the belt 34 and to elastically contact the inner surface of the belt 34 at its temperature detecting portion.

2) Pressing Roller 32

The pressing roller 32 is a heat-resistant elastic roller prepared by providing an elastic layer 32*b* of a heat-resistant rubber such as a silicone rubber or a fluorine-containing rubber or of a foam member of the silicone rubber, to a metal core 32*a*. In order to improve a surface property, at an outer peripheral surface of the pressing roller 32, a fluorine-containing resin material layer 32*c* of PTFE, PFA, FEP, or the like may also be provided.

The pressing roller 32 is rotatably supported and disposed between the left and right opposite side plates, 51L and 51R through bearing members 54L and 54R at both (left and right) end portions of its metal core 32*a*. At the right end of the metal core 32*a*, a drive gear G is fixedly provided.

Between the pressure-receiving portion 38*a* of the left capping member 38L of the belt unit 31 and a left spring receptor 55L provided to the device frame 50 and between the pressure-receiving portion 38*b* of the right capping member 38R and a right spring receptor 55R, urging springs 56L and 56R are provided, respectively, in a compressed state. A predetermined expansion force F of the left and right urging springs 56L and 56R acts on the fixing pad 35 through the pressure-receiving portions 38*a* of the left and right capping members 38L and 38R and through the pressing stay 36. As a result, the fixing pad 35 press-contacts the belt 34 to press the pressing roller 32 against elasticity of the elastic layer 32*b*, so that a nip N with a predetermined width with respect to the sheet conveying direction is formed between the belt 34 and the pressing roller 32. The fixing pad 35 assists formation of pressure profile in the nip N.

3) Exciting Coil Unit 33

The coil unit 33 includes a curved portion which is curved along the outer peripheral surface of the substantially cylindrical belt 34 in a substantially semicircular range in cross section. The coil unit 33 is disposed in parallel with the belt unit 31 with respect to their longitudinal directions with a predetermined spacing a between its inner surface and the outer surface of the belt 34 on an opposite side from the pressing roller 32 side with respect to the belt unit 31. The coil unit 33 is disposed between the left and right opposite side plates 51L and 51R by being attached to the device frame 50 through left and right brackets 57L and 57R on its left and right sides.

In this embodiment, the coil unit 33 includes an exciting coil 41, a first magnetic core 42*a* provided at a winding central portion of the coil 41, and a second magnetic core 42*b* provided on a side opposite from the belt 34 side with respect to the coil 41. The coil 41 and the magnetic cores 42*a* and 42*b* are stored in a holder (casing) 43 as a supporting member. The first and second magnetic cores 42*a* and 42*b* and the above-described magnetic core 37 provided inside the belt 34 are formed of the ferromagnetic material which may preferably be ferrite or the like having high magnetic permeability and low residual magnetic flux density.

The coil 41 has a substantially elliptical shape (elongated boat shape) with respect to its longitudinal direction and is disposed inside the holder 43 so as to follow the outer peripheral surface of the belt 34. As a core wire of the coil 41, Litz wire prepared by bundling approximately 80-160 strands of fine wires having a diameter of 0.1-0.3 mm is used. As the fine wires, insulation coating electric wires are used. The Litz wire is wound 8 to 12 times around the magnetic cores 42*a* and 42*b* to constitute the coil 41 to be used. To the coil 41, an exciting circuit 101 is connected, so that an alternating current can be supplied to the coil 41.

The magnetic cores 42*a* and 42*b* are configured to cover the winding central portion and its peripheral portions of the coil 41, thus performing the function of efficiently introducing AC magnetic flux generated from the coil 41 into the electroconductive layer 34*b* of the belt 34. That is, the magnetic cores 42*a* and 42*b* are used for an increase in efficiency of the magnetic circuit 101 and for magnetic shielding.

4) Fixing Operation

With predetermined control timing on the basis of the image formation start signal input from the external host device 200, the control circuit portion 100 effects so-called warming up such that the temperature of the belt 34 of the fixing device 21 is increased up to a temperature suitable for heat-fusing the toner image. The printer 1 is placed in an image formable state after the surface temperature of the belt 34 reaches a predetermined temperature of, e.g., 180° C. The warming up of the fixing device 21 is performed in such a manner that the pressing roller 32 starts its rotation and correspondingly the belt 34 starts its circulation movement and at the substantially same time or immediately after the start of the movement of the belt 34, the alternating current is supplied from the exciting circuit 101 to the coil 41 of the coil unit 33.

The pressing roller 32 is driven by turning on a fixing motor M (a driving source for rotationally driving the rotatable pressing member).

A driving force from the fixing motor M is transmitted to the drive gear G through a power transmitting system (not shown), so that the pressing roller 32, which is the rotatable pressing member, is rotationally driven in the counterclockwise direction indicated by the arrow in FIG. 4 at a predetermined speed. By the rotation of the pressing roller 32, a frictional force is generated between the surface of the pressing roller 32 and the surface of the belt 34 in the fixing nip N, thus exerting a rotational force on the belt 34. As a result, the belt 34 is rotated around the outer surface of the guiding member 35 by the pressing roller 32 at the substantially same rotational speed as that of the pressing roller 32 in the counterclockwise direction indicated by the arrow while intimately sliding the lower surface of the fixing pad 35 in the fixing nip N at its inner surface. Shifting movement of the belt 34 in the longitudinal direction due to the rotation of the belt 34 is rotated by receiving the belt left end surface by the flange portion 38*b* of the left capping member 38L or by receiving the belt right end surface by the flange portion 38*b* of the right capping member 38R.

Further, the control circuit portion 100 turns on an exciting circuit (electromagnetic induction heating driving circuit or high-frequency converter) 101. As a result, the alternating circuit (high-frequency current) is caused to flow from an AC power source 102 to the coil 41 of the coil unit 33. Then, the magnetic flux indicated by H around the coil 41 in FIG. 4 is repetitively generated and turned off. Further, when the magnetic flux H is guided by the magnetic cores 42*a* and 42*b* to cross the electroconductive layer 34*b* of the belt 34, eddy current is generated in the electroconductive layer 34*b* so as to create a magnetic field for preventing a change in magnetic field by the magnetic flux H. The eddy current generates Joule heat by the specific resistance of the electroconductive layer 34*b*. That is, Joule heat is generated in proportion to the skin resistance of the electroconductive layer 34*b* or the magnitude of the current passing through the electroconductive layer 34*b*. By the heat generation of the electroconductive layer 34*b*, the rotating belt 34 is increased in temperature.

On the other hand, the thickness of the electroconductive layer 34*b* of the belt 34 is smaller than the skin depth of the belt 34, so that the magnetic flux penetrates through the electroconductive layer 34*b* to form a closed path (circuit) toward the magnetic core 37 disposed inside the belt 34. At this time, the magnetic core 37 is disposed closest to the belt 34 while keeping a certain distance therebetween, so that the closed magnetic circuit is in an extremely closed state, in which the magnetic flux density is enhanced effectively to induction-heat the belt 34 with no temperature non-uniformity.

Then, the temperature of the belt 34 is detected by the thermistor TH, so that electrical information on the detecting temperature is input into the control circuit portion 100 through an A/D converter 103. The control circuit portion 100 controls the exciting circuit 101 so that the belt temperature is increased and kept at a preset temperature (fixing temperature) on the basis of the detected temperature information from the thermistor TH. That is, the control circuit portion 100 controls the electric power supply (energization) from the AC power source 102 to the coil 41.

In the above-described manner, the pressing roller 32 is driven and the belt 34 is temperature-controlled so as to increase in temperature up to the predetermined fixing temperature. In this state, the sheet P carrying thereon unfixed toner images t is introduced into the fixing nip N with a toner image carrying surface directed toward the belt 34 side. The sheet P intimately contacts the outer peripheral surface of the belt 34 in the fixing nip N and is nip-conveyed through the fixing nip N together with the belt 34. As a result, heat of the belt 34 is applied to the sheet P and the sheet P is subjected to the application of the nip pressure, so that the unfixed toner images t are heat-fixed to the surface of the sheet P as a fixed image. The sheet P having passed through the fixing nip N is separated from the outer peripheral surface of the belt 34 to be conveyed to the outside of the fixing device.

Here, the conveyance of the sheets P having large and small (various) widths or sizes in the printer and the fixing device in this embodiment is performed in a so-called center line basis conveyance mode in which a center line of the sheet P with respect to a width direction of the sheet P is taken as a reference line. In FIGS. 2 and 3, a reference symbol O represents a center reference line (a phantom line) for the sheet conveyance. Further, a reference symbol Wmax represents a sheet passing width of the sheet, having a maximum sheet passing width, capable of passing through the printer or the fixing device.

(3) Regulation of Rotation Locus of Belt 34 by Guiding Member 38*c*

As described above, in the case where the belt 34 is driven by a conveying force of the pressing roller 32 with no application of tension to the flexible thin belt 34 (the free belt type), the belt 34 flaps with respect to its circumferential direction.

Figure 7:
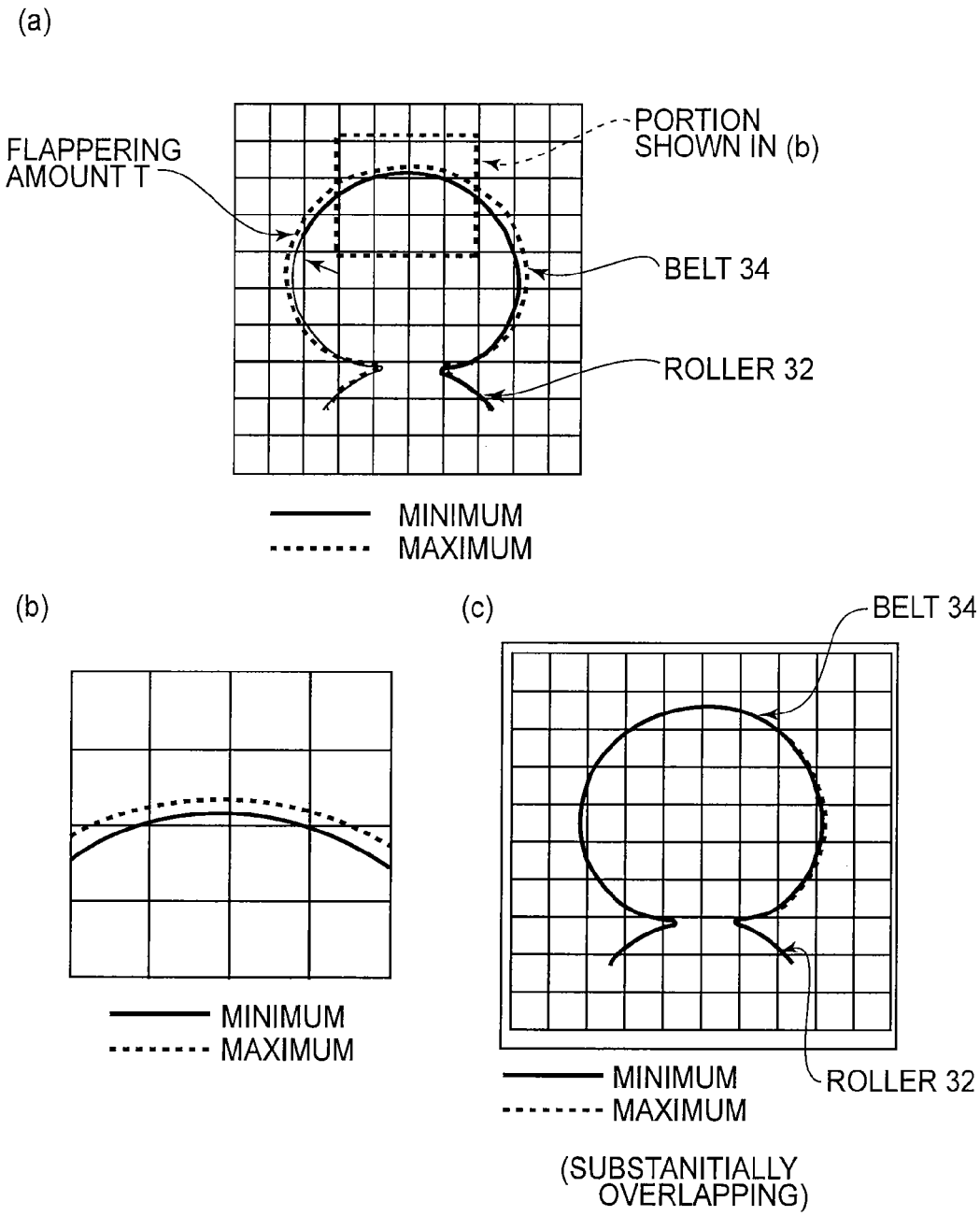
FIGS. 7(*a*) to 7(*c*) are schematic views for illustrating a locus of the fixing device in the case where a guiding member is not provided (FIGS. 7(*a*) and 7(*b*)) or is provided (FIG. 7(*c*)).

FIGS. 7(*a*) and 7(*b*) show a result of measurement of a locus of the belt 34 by the present invention when the belt 34 is driven by the conveying force of the pressing roller 32 without being guided by the guiding member 38*c*. In the case where the belt 34 is driven by the rotation of the pressing roller 32 in the nip N without being guided, the belt 34 flaps with respective to its circumferential direction.

In order to prevent interference between the coil unit 33 and the thus flapping belt 34, in view of the flapping of the belt 34 (maximum belt locus), the coil unit 33 is disposed so as to maintain the distance (gap) a with respect to the maximum locus of the belt 34. When the degree of the flapping of the belt 34 is increased, the distance a between the coil unit 33 and the belt 34 becomes unstable, so that heat generation non-uniformity is caused to occur.

Therefore, in order to solve the above problem, there is the need to stabilize the locus of the belt 34. In this embodiment, each of the left and right capping members 38L and 38R includes the guiding member 38*c* for regulating the rotation locus of the belt 34 from the inside of the belt 34 rotated by the rotational drive of the pressing roller 32. Further, the rotation locus of the belt 34 is regulated only at the both end portions with respect to the longitudinal direction of the belt 34. That is, the guiding members 38*c* disposed opposite to the belt 34 at both end portions of the belt 34 guide the rotation locus of the belt 34 only at the both end portions when the belt 34 is driven by the pressing roller 32.

In this embodiment, the guiding members 38*c* are provided to the inner side surfaces of the flange portions 38*b* of the capping members 38L and 38R as an arcuate eave-like member having an outer diameter substantially corresponding to an inner diameter of the cylindrical belt 34. The capping members 38*c* are, as shown in FIG. 3, disposed at both end portions in non-sheet-passing areas of the sheet P, i.e., disposed outside the maximum sheet passing width area Wmax of the sheet P, and regulate the rotation locus of the belt 34 at both end portions of the belt 34 with respect to the longitudinal direction of the belt 34. More specifically, the guiding members 38*c* enter the inside (inner area) of the belt 34 from the left and right end portions of the belt 34, thus performing the function of supporting the belt 34 from the inside of the belt 34 and of guiding the rotation locus of the belt 34. That is, the arcuate outer surface of each guiding member 38*c* guides the inner surface of the belt 34 to stabilize the rotation locus of the belt 34. The arcuate outer surface of the guiding member 38*c* is a position X in which the guiding member 38*c* guides the belt 34 (FIG. 6). However, in order to reduce the load on the belt 34, the outer surface of the guiding member 38*c* for guiding the inner surface of the belt 34 is configured to face the inner surface of the belt 34 partly, not wholly.

The position X in which the guiding member 38*c* guides the belt 34 will be described with reference to FIGS. 7(*a*) to 7(*c*) and 8. The belt 34 in a non-load state has a substantially circular shape in cross section. On the other hand, when the belt 34 is driven by the rotation of the pressing roller 32 in a pressed state in which the belt 34 is nipped between the fixing pad 35 and the pressing roller 32, as shown in FIG. 7(*a*), the belt 34 draws maximum and minimum elliptical loci. The guiding member 38*c* for stabilizing the rotation locus of the belt 34 guides the belt 34 so that the rotation locus of the belt 34 is the above-described elliptical shape in order to reduce the load on the belt 34. The rotation locus of the belt 34 guided by the guiding member 38*c* is defined, on the basis of the state of FIG. 7(*a*), by a curvature R1 of the guiding member 38*c*, a long axis La, and a short axis Lb which is the distance between the bottom of the fixing pad 35 and an apex portion of the guiding member 38*c*. In order to reduce the load on the belt 34 by the guiding member 38*c*, a circumferential length of the rotation locus of the belt 34 defined by the guiding member 38*c* and the fixing pad 35 is smaller than that of the inner surface of the belt 34. Further, as described above, the guide position X of the guiding member 38*c* is not present in the entire inner circumferential area of the belt 34 but is present in a part of the inner circumferential area of the belt 34. Further, the shape of the guiding member 38*c* is such that the inner surface of the coil unit 33 follows the opposing surface of the belt 34.

Figure 8:
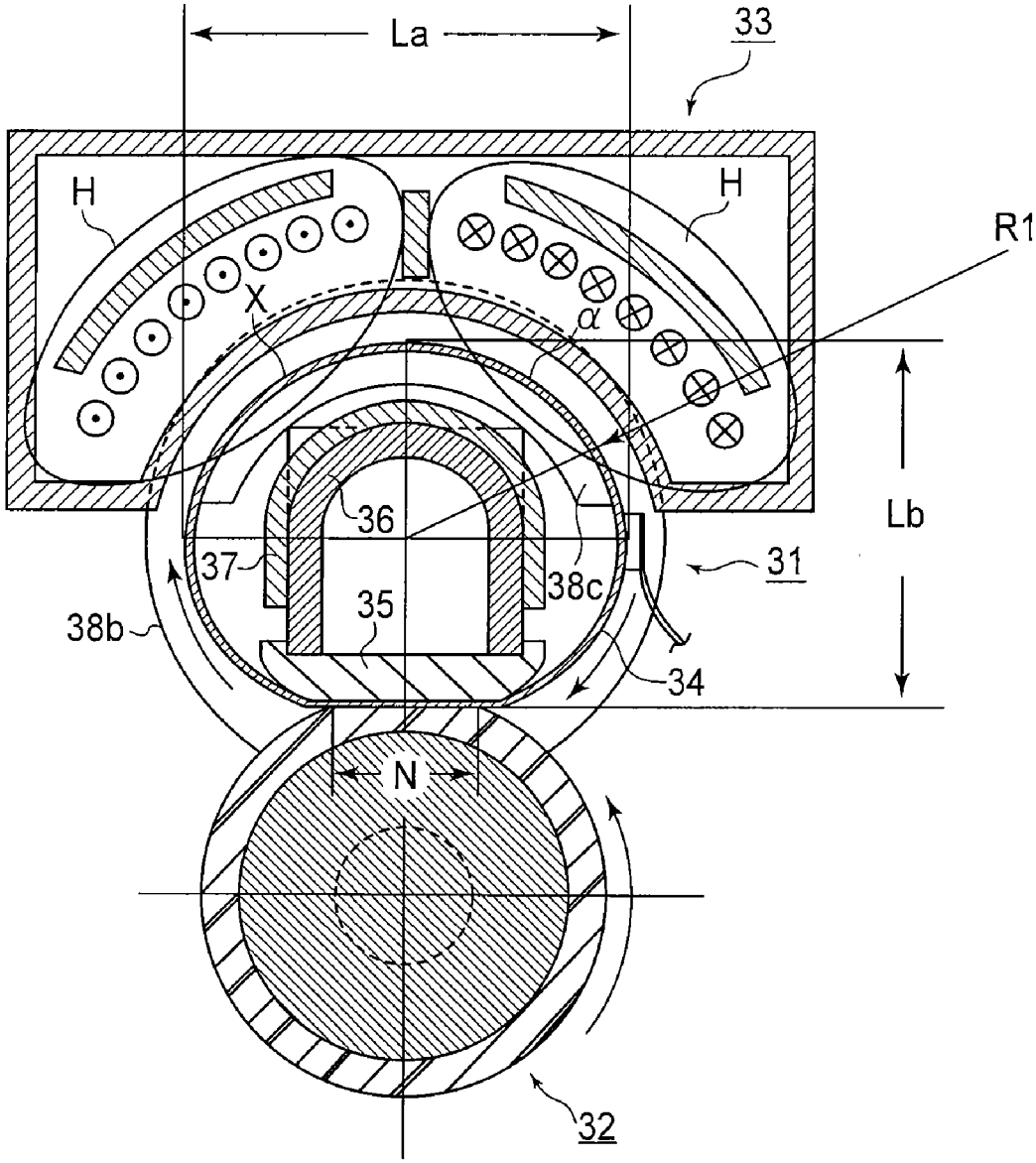
FIG. 8 is a schematic view for illustrating a position in which the guiding member guides the fixing belt.

The above-described curvature R1, long axis La, and short axis Lb will be described. The curvature R1 of the guiding member 38*c* is a radius of an arc when the shape of the belt 34 with respect to the coil unit 33 is subjected to arc approximation as shown in FIG. 8 on the basis of the maximum locus of the belt 34 shown in FIG. 7(*a*). The long axis La is the length of the guiding member 38*c* having a curved surface with the curvature R1 with respect to the sheet conveying direction. Further, the long axis La is determined so that the guide position X at least ensures the magnetic flux area indicated by H in FIG. 8 in order to stabilize the rotation locus of the belt 34 and cause the induction heating in the magnetic flux area H in FIG. 8. The short axis Lb is the height from the bottom of the fixing pad 35 (the fixing nip surface) to the apex portion of the guiding member 38*c*.

Specifically, in this embodiment, as the belt 34, the flexible thin belt having the following features was used.

Inner layer 34*a:* 30 μm-thick polyimide (PI)

Electroconductive layer 34*b:* 30-40 μm thick Ni layer providing an inner meter of 30 mm Elastic layer 34*c:* 300 μm-thick silicone rubber layer Surface parting layer 34*d:* 40 μm-thick PFA layer When this belt 34 was driven by the pressing roller 32 without being guided by the guiding member 38*c*, the flapping amount of the locus of the belt 34 (belt locus displacement) T shown in FIGS. 7(*a*) and 7(*b*) was 1.5 mm at the maximum.

On the other hand, in the constitution in which the locus of the belt 34 was guided, the belt locus was guided by the guiding member 38*c* having the inner diameter of 30 mm (inner circumferential length of the belt 34: 94.25 mm), R1 of 15.3 mm, La of 31 mm, Lb of 27 mm, and the circumferential length of 53.89 mm at the guide position X. Further, the circumferential length of the locus of the belt 34 defined by the guiding member 38*c* was 92.36 mm which was smaller than the inner circumferential length (94.25 mm) of the belt 34.

When the belt 34 is guided by the guiding member 38*c* in the above-described constitution, a result of measurement of a maximum locus and a minimum locus is shown in FIG. 7(*c*).

In the loci shown in FIG. 7(*c*), the maximum of the displacement T of the belt locus was decreased to 0.26 mm, so that it was possible to stabilize the belt locus.

Therefore, in this embodiment, at the position in which the guiding member 38*c* regulates the rotation locus of the belt 34, the coil unit 33 is disposed opposite to the belt 34. That is, as shown in FIGS. 4 and 8, the coil unit 33 is disposed at the position in which the guiding member 38*c* opposes the coil unit 33 and is located at the position X in which the locus of the belt 34 is stabilized. The amount of the magnetic flux generated by the coil unit 33 is a maximum at the position X, in which the belt 34 is induction-heated.

By employing this constitution, the flapping of the belt 34 is suppressed, so that the distance between the locus of the belt 34 and the coil unit 33 can be stabilized to reduce the degree of heat generation non-uniformity.

Embodiment 2

Figure 9:
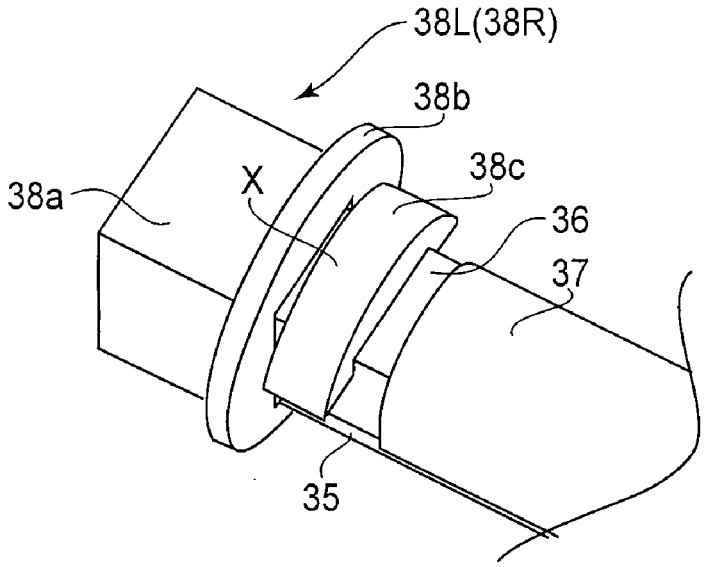
FIGS. 9(*a*) and 9(*b*) and FIG. 10 are schematic views each showing a principal part of the fixing device in Embodiment 2.
Figure 9:
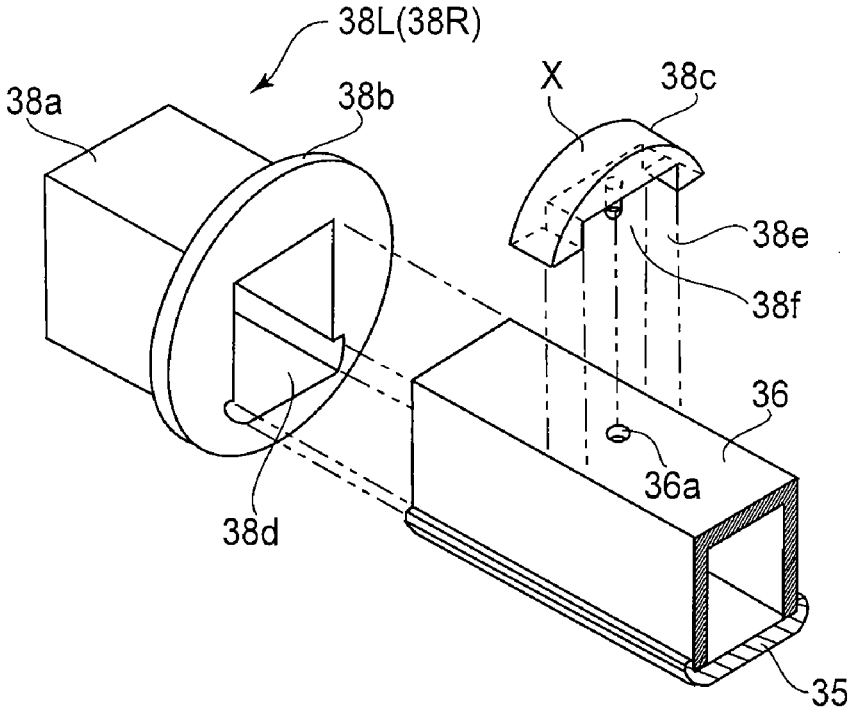
Figure 10:
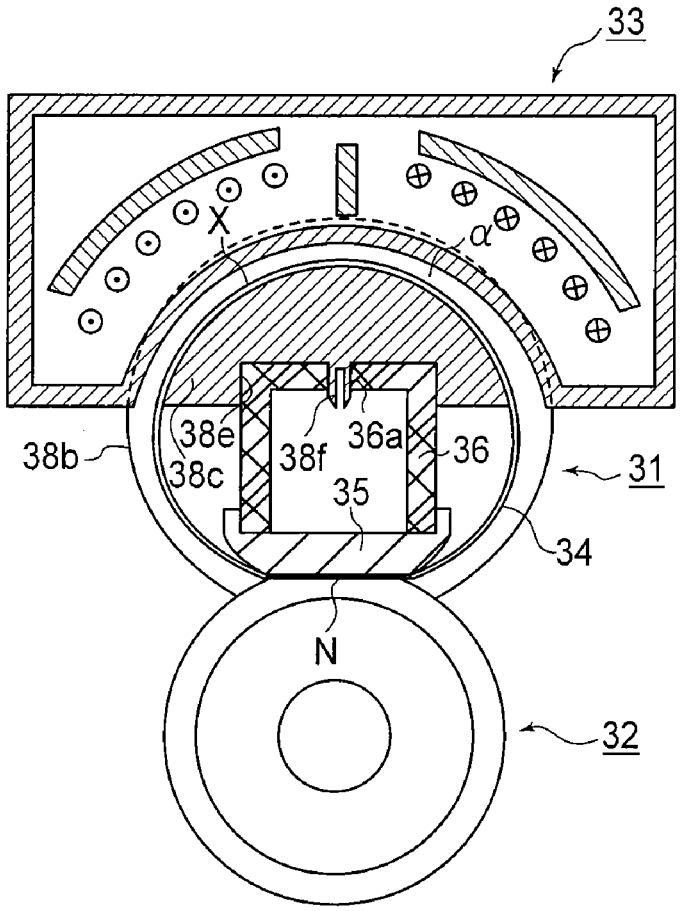

FIGS. 9(*a*), 9(*b*) and 10 show a principal portion in this embodiment. In this embodiment, the pressing stay 36 has a reversed U-like shape with square-corned portions in cross section. Further, the guiding members 38*c* are constituted as separate member from the capping members 38L and 38R and are attached and provided to the pressing stay 36. In this embodiment, each of the guiding members 38*c* is provided with a recess 38*e* to be engaged with the pressing stay 36 and provided with a projection 38*f* to be engaged in a spot (hole) 36*a* provided to the pressing stay 36, thus being attached to the pressing stay 36. Other constitutions of the fixing device in this embodiment are similar to those in Embodiment 1.

Also in this embodiment, the left and right guiding members 38*c* have the function of supporting the belt 34 from the inside of the belt 34 and of guiding the rotation locus of the belt 34. That is, the arcuate outer surface X of each of the guiding members 38*c* guides the inner surface of the belt 34 to stabilize the rotation locus of the belt 34. Further, at the position in which the guiding member 38*c* regulates the rotation locus of the belt 34, the coil unit 33 is disposed opposite to the belt 34. That is, the coil unit 33 is disposed at the position in which the guiding member 38*c* opposes the coil unit 33 and is located at the position X in which the locus of the belt 34 is stabilized. The amount of the magnetic flux generated by the coil unit 33 is a maximum at the position X, in which the belt 34 is induction-heated.

By employing this constitution, the flapping of the belt 34 is suppressed, so that the distance between the locus of the belt 34 and the coil unit 33 can be stabilized to reduce the degree of heat generation non-uniformity.

Embodiment 3

Figure 11:
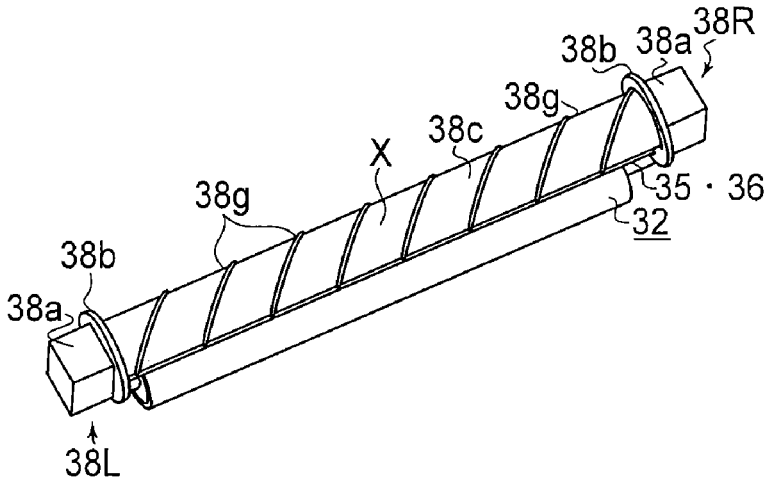
FIGS. 11 and 12 are schematic views showing a principal part of the fixing device in Embodiment 3.

FIG. 11 shows a principal portion in this embodiment. In this embodiment, the guiding member 38*c* guides the belt 34 over the longitudinal direction of the belt 34. The guiding member 38*c* has a rib structure with respect to its longitudinal direction in order to decrease the sliding resistance with respect to the inner surface of the belt 34. That is, the guiding member 38*c* is provided with a rib 38*g*. In order to reduce the degree of temperature non-uniformity of the belt 34 due to heat conduction from the belt 34 to the guiding member 38*c*, the rib 38*g* is disposed so as to be inclined with respect to the rotational direction of the belt 34. Other constitutions of the fixing device in this embodiment are similar to those in Embodiment 1.

In this embodiment, the guiding member 38*c* is disposed with respect to the belt longitudinal direction and has the function of supporting the belt 34 from the inside of the belt 34 and of guiding the rotation locus of the belt 34. That is, the arcuate outer surface X of the guiding member 38*c* having the rib 38*g* guides the inner surface of the belt 34 to stabilize the rotation locus of the belt 34. Further, at the position in which the guiding member 38*c* regulates the rotation locus of the belt 34, the coil unit 33 is disposed opposite to the belt 34. That is, the coil unit 33 is disposed at the position in which the guiding member 38*c* opposes the coil unit 33 and is located at the position X in which the locus of the belt 34 is stabilized. The amount of the magnetic flux generated by the coil unit 33 is a maximum at the position X, in which the belt 34 is induction-heated.

By employing this constitution, the flapping of the belt 34 is suppressed, so that the distance between the locus of the belt 34 and the coil unit 33 can be stabilized to reduce the degree of heat generation non-uniformity.

Embodiment 4

Figure 12:
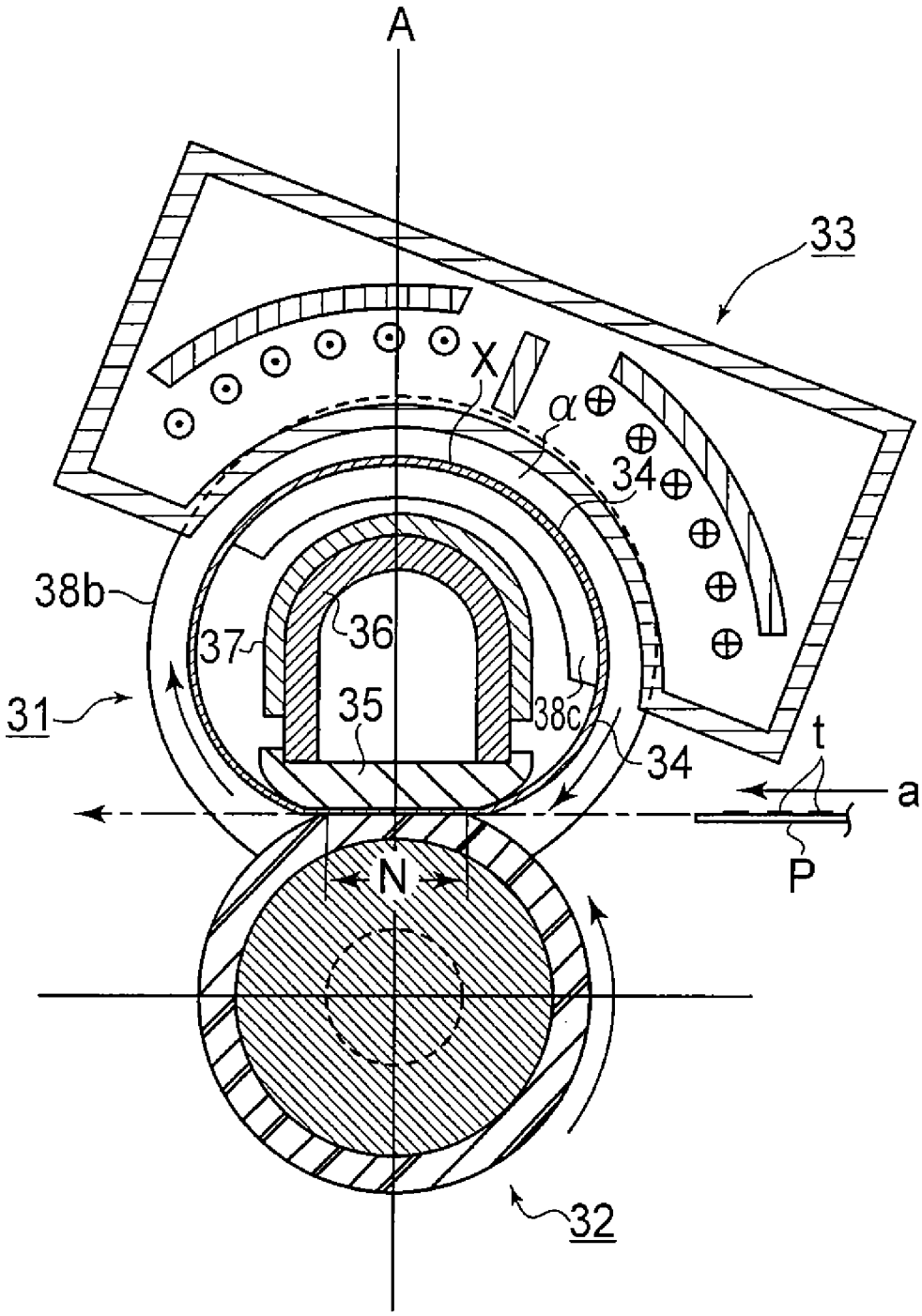

FIG. 12 shows a principal portion in this embodiment. In this embodiment, the guide position X of the belt 34 by the guiding members 38*c* is located upstream of a perpendicular line A passing through a center of the width of the nip N (nip short direction central portion) with respect to a conveying direction of the sheet P. Further, at the position in which the guiding members 38*c* regulate the rotation locus of the belt 34, the coil unit 33 is disposed opposite to the belt 34. That is, the guiding members 38*c* for guiding the locus of the belt 34 are disposed so as to be inclined toward the upstream side of the sheet P conveying direction. Other constitutions of the fixing device in this embodiment are similar to those in Embodiment 1.

Also in this embodiment, similarly as in Embodiment 1, the left and right guiding members 38*c* have the function of supporting the belt 34 from the inside of the belt 34 and of guiding the rotation locus of the belt 34. That is, the arcuate outer surface X of each of the guiding members 38*c* guides the inner surface of the belt 34 to stabilize the rotation locus of the belt 34. Further, at the position in which the guiding member 38*c* regulates the rotation locus of the belt 34, the coil unit 33 is disposed opposite to the belt 34. That is, the coil unit 33 is disposed at the position in which the guiding member 38*c* opposes the coil unit 33 and is located at the position X in which the locus of the belt 34 is stabilized. The amount of the magnetic flux generated by the coil unit 33 is a maximum at the position X, in which the belt 34 is induction-heated.

By employing this constitution, the flapping of the belt 34 is suppressed, so that the distance between the locus of the belt 34 and the coil unit 33 can be stabilized to reduce the degree of heat generation non-uniformity. Further, by disposing the coil unit 33 on the upstream side of the perpendicular line A with respect to the sheet P conveying direction, the heating source is brought near to the nip N, so that the WUT can be further improved.

In Embodiments 1 to 4 described above, the belt member is used as the heating member (heat generating member) 34 but even in a constitution in which a thinner film member is used as the heating member 34, it is also possible to achieve the same effect as in the constitution using the belt member.

The image forming apparatus and the fixing device may also have a constitution in which the passing of the recording material is performed on one-side sheet passing basis.

The image heating apparatus according to the present invention can be used not only as the image heat fixing device but also as other image heating apparatuses such as an image heating apparatus for modifying a surface property (e.g., glossiness or the like) by heating the recording material on which an image is carried, and an image heating apparatus for temporarily fixing the image. Further, it is also possible to use the image heating apparatus of the present invention as an image heating apparatus for drying the recording material which has been subjected to image formation in an ink jet manner in an image forming apparatus of the ink jet type.

According to the present invention, it is possible to keep the distance between the belt and the magnetic field generating means at a substantially uniform level. As a result, it is possible to provide an image heating apparatus of an electromagnetic induction heating type in which the degree of the heat generation non-uniformity can be reduced and the free-belt constitution providing the small thermal capacity, good thermal responsiveness, and the reduced waiting time is employed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 320764/2008 filed Dec. 17, 2008, which is hereby incorporated by reference.

What is claimed is:

1. An image heating apparatus comprising:

a magnetic flux generating unit configured to generate magnetic flux;

a rotatable endless belt member including an electroconductive layer which generates heat by the magnetic flux generated by said magnetic flux generating unit and having flexibility, wherein said magnetic flux generating unit is provided outside said belt member;

a back-up member disposed inside said belt member;

a rotatable contacting member configured to contact said belt member to form a nip with said back-up member between said belt member and said contacting member, in which a recording material is nip-conveyed, between said contacting member and said belt member, wherein when said nip is formed, at least a part of said belt member has an elliptical shape;

a regulating member configured to regulate movement of the belt member from an inside of said belt member, wherein said regulating member regulates movement of said belt member in a shape such that said regulating member follows the elliptical shape of said belt member; and flanges, disposed at both end portions of said belt member, configured to support said belt member, wherein each of said flanges is provided with said regulating member.

2. An apparatus according to claim 1, wherein said regulating member has a shape following a shape of a surface where said magnetic flux generating member opposes said belt member.

3. An apparatus according to claim 1, further comprising a magnetic core disposed inside said belt member and disposed in a sheet passing area, said magnetic core being spaced from said belt member in the sheet passing area.

4. An apparatus according to claim 1, wherein, said regulating member is disposed only outside a range, with respect to a longitudinal direction of said belt member, in which a recording material of a maximum size passes through said image heating apparatus.

5. An apparatus according to claim 1, said regulating member regulates said belt member at a position in which said regulating member opposes said magnetic flux generating unit.

6. An apparatus according to claim 1, wherein, said regulating member opposes a part of an inner circumferential area of said belt member with respect to a circumferential direction of said belt member.

7. An apparatus according to claim 1, further comprising a motor configured to drive said contacting member, wherein, said contacting member drives said belt member.

8. An apparatus according to claim 1, wherein said elliptical shape of the part of the belt member has a long axis with respect to a recording material conveying direction and a short axis with respect to a direction perpendicular to the recording material conveying direction.

* * * * *